United States Patent [19]

Brucksch

[11] Patent Number: 5,039,829

[45] Date of Patent: Aug. 13, 1991

[54] PUSH-PULL SWITCH AND LOCK THEREFOR

[76] Inventor: Robert C. Brucksch, 3836 Prospect Rd., Harford County, Md. 21154

[21] Appl. No.: 502,587

[22] Filed: Mar. 30, 1990

[51] Int. Cl.[5] ..... H01H 9/28

[52] U.S. Cl. ..... 200/43.18; 200/43.13; 200/43.19; 200/43.21; 200/331; 200/341; 200/327; 200/318.1; 70/DIG. 30

[58] Field of Search ..... 200/43.11, 43.16, 43.17, 200/43.18, 43.19, 43.21, 318.1, 321, 322, 327, 296, 331, 341, 345, 43.01, 338, 523; 70/DIG. 30

[56] References Cited

U.S. PATENT DOCUMENTS

| | | | |
|---|---|---|---|
| 2,847,526 | 8/1958 | Pearce | 200/43.21 |
| 4,324,964 | 4/1982 | Edenharter et al. | 200/331 |
| 4,497,987 | 2/1985 | Melys | 200/43.19 |

FOREIGN PATENT DOCUMENTS

| | | | |
|---|---|---|---|
| 2725797 | 12/1978 | Fed. Rep. of Germany | 200/43.18 |

*Primary Examiner*—Ernst G. Cusick

[57] ABSTRACT

The invention is an assembly of a push-pull switch and a device to selectively limit the action of the push-pull switch. The switch has a body, a plunger translatable into or from the body, and a round head on the plunger. The switch opens or closes depending on whether the plunger is extended or retracted. The device is comprised of two semi-cylindrical sleeve halves that fit together to form a complete sleeve about the head of the plunger. The sleeve is open at both ends, has two internal grooves into which the head can snugly fit, and has an external groove to accommodate a clip, tie or like mechanism for holding the sleeve halves together. Depending on which internal groove is fit over the head and on which end of the sleeve faces the body of the switch, the plunger will either be locked in an extended position or will be prevented from resting in a retracted position. One embodiment of the invention has a mechanism to hold the sleeve onto the body of the switch so that the plunger is held in the retracted position. The various possible restrictions by the sleeve on the translation of the plunger can be used to limit, as desired, the normal operation of the switch.

8 Claims, 3 Drawing Sheets

PUSH-PULL SWITCH AND LOCK THEREFOR

GOVERNMENT INTEREST

The invention described herein may be manufactured, used, and licensed by or for the Government for governmental purposes without payment to me of any royalty thereon.

BACKGROUND AND SUMMARY

The invention relates to mechanisms for holding switches within an array in selected positions.

The invention is a specially designed sleeve which can be fit onto conventional push-pull type switches on a control panel or on an array of such switches. Because of its compact configuration, the sleeve can lock a given switch into position without interfering with the operation of nearby switches, even when the switches are closely spaced. The collar can be fit onto the switch in a variety of ways to achieve different limitations on the operation of the switch or to allow the collar to retain an identifier knob so as to flag selected switches on an array.

DETAILED DESCRIPTION

Figure 1:
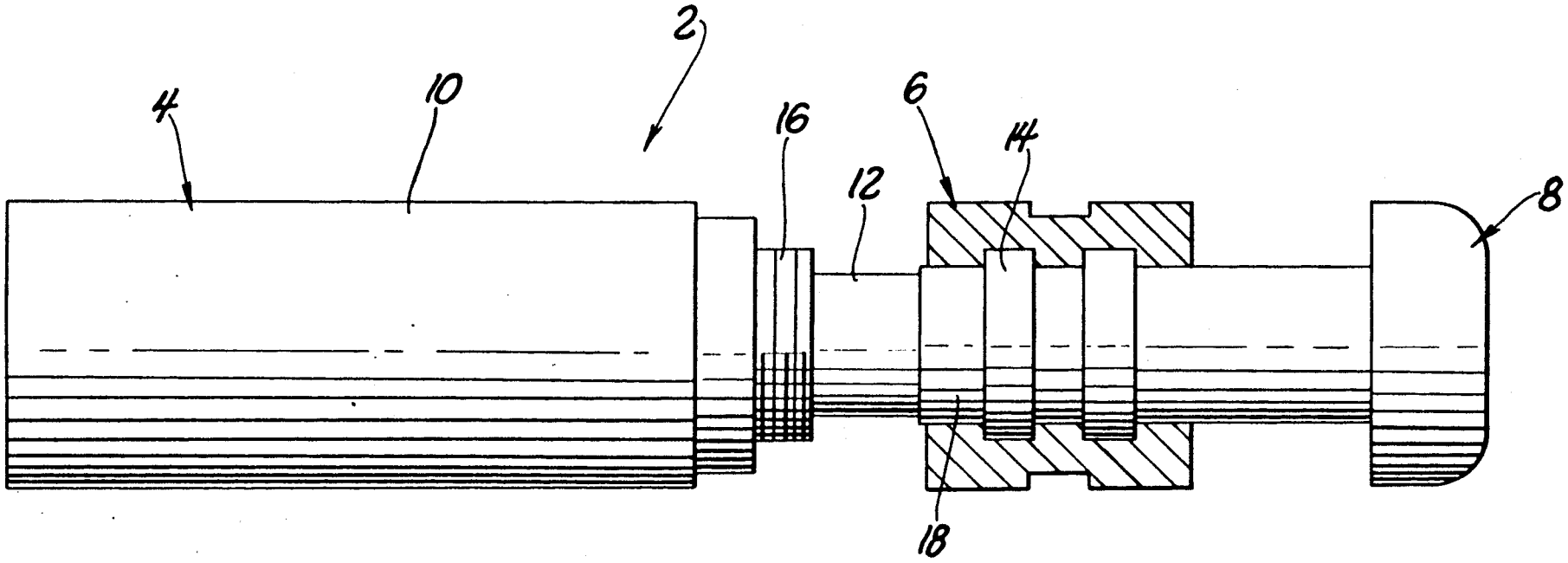
FIG. 1 is an elevational view showing the assembly of my collar and knob on a conventional switch mechanism, the plunger of the switch assembly being in the extended position.
Figure 3:
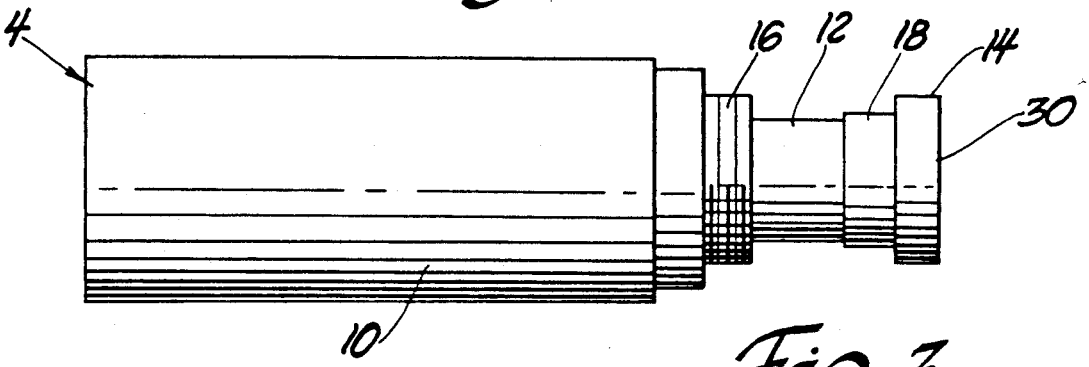
FIG. 3 is an elevational view of the switch mechanism alone, with the plunger in the extended position.

Shown in FIG. 1 is an assembly 2 of a conventional switch mechanism 4, a collar or sleeve 6 and a knob 8. Switch mechanism 4 is typically a circuit breaker switch and is shown by itself in FIG. 3. The switch mechanism has an elongate body 10 from which extends an axially translatable plunger 12 terminating in a disk-like head 14. An externally threaded annulus 16 at one end of body 10 encircles plunger 12 and has an internal diameter sufficient to allow freedom of translational movement for plunger 12. Plunger 12 is spring loaded so as to seek one of two translational positions, the first, extended translational position being shown in FIGS. 1 and 3. The second, retracted translational position of the plunger occurs when the intermediate diametrical portion 18 of plunger 12 abuts against annulus 16. If plunger 12 is moved to a position between the extended and retracted translational positions and then released, plunger 12 will move either to the retracted or the extended position.

Figure 4:
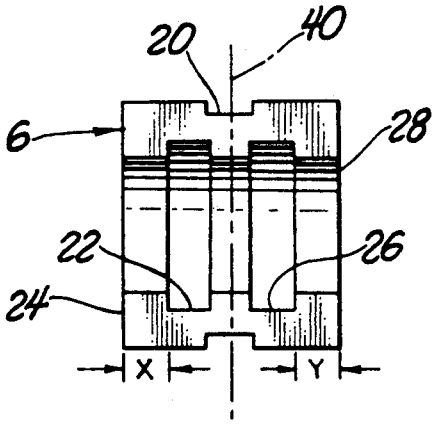
FIG. 4 is an elevational view of one of the halves of my collar showing in section a retaining means for keeping the halves of the collar together.
Figure 5:
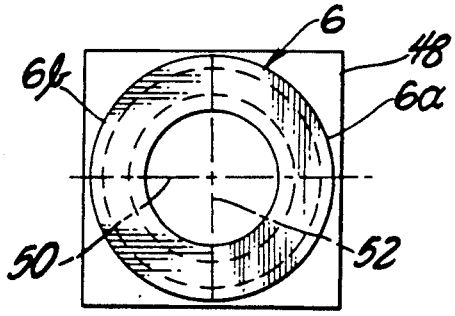
FIG. 5 is an end view of my collar showing in block form a retention means for holding the halves of the collar together.
Figure 6:
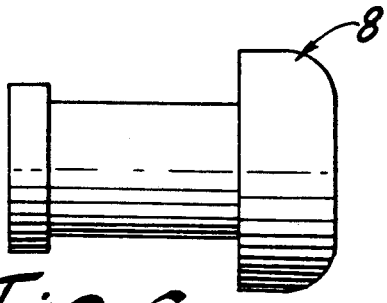
FIGS. 6 and 7 are views of the knob which can be held by my collar showing a retaining means for keeping the halves of the collar together.
Figure 7:
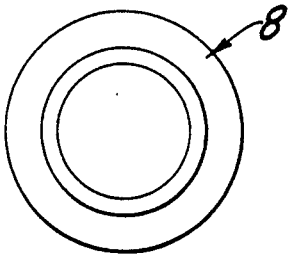

FIGS. 4 and 5 show details of collar 6, which is comprised of two symmetric semi-cylindrical halves **6*a* and 6*b*. Lines 50 and 52 in FIG. 5 are disposed respectively along the horizontal and vertical centerlines of collar 6, line 52 being at the boundary between halves 6*a* and 6*b*. Collar 6 has an exterior annular groove 20 for accommodating an adjustable tie or a length of flexible wire used to tie or bind the halves 6*a* and 6*b* together. Optionally, groove 20 can be used to accommodate a circular clip 48 or any other means to keep the halves together. A retention means to keep the halves of the collar together is shown in block form at 48 in FIG. 5. FIG. 5 is not intended to show any particular form or configuration of retention means, but is merely intended to show the existence of a means for holding the halves of the collar together. Collar 6 has a first internal annular groove 22 disposed an axial distance "x" from one open end 24 of the collar and has a second internal annular groove 26 disposed an axial distance "y" from the other open end 28 of the collar. Either internal annular groove can snugly retain head 14 of plunger 12, and if halves 6*a* and 6*b* are assembled onto plunger 12, one of the internal grooves will capture head 14 to keep collar 6 on plunger 12**.

It is possible to fit collar 6 onto plunger 12 in a variety of ways so as to accomplish different results. For example, if collar 6 is fit onto plunger 12 so that head 14 is in internal annular groove 26 and end 24 is faced toward annulus 16 on body 10, then plunger 12 can not retract into body 10 from its extended, FIG. 2 position. When plunger 12 is in the extended position, then switch assembly 2 will be in an open, or circuit breaking, mode. In the preferred embodiment, collar 6 is symmetrical with respect to a bisecting plane 40. Thus if head 14 is captured in groove 22 and end 28 of collar 6 faces annulus 16, the configuration of collar 6 and switch assembly 2 is the same as when head 14 is captured in groove 26 and end 24 faces annulus 16.

It is also possible to fit collar 6 onto plunger 12 so that the plunger head 12 is held in internal annular groove 22 of collar 6 and end 24 faces toward annulus 16 of switch assembly 4. Dimension "x" is selected so that plunger 12 may be moved all the way to its retracted position. The spring loading on plunger 12 is such that the plunger is biased to stay in the retracted position once the plunger arrives there. Of course, the spring loading on the plunger is also such that the plunger will be biased to remain in the extended position once the plunger is placed there. Similarly, if head 14 is captured in groove 26 when end 28 faces annulus 16, then collar 6 will not interfere with translation of plunger 12 to its fully retracted position. The smaller end of knob 8 can then be captured in the groove which is more remote from annulus 16. Knob 8 will then serve as a flag to specially identify a particular switch assembly 2. Optionally, knob 8 need not be used, whereby end face 30 on plunger 12 can be viewed by looking through the appropriate open end 24 or 28. This option would be useful in cases where an identifier such as a switch number is on end face 30 of the plunger.

Figure 2:
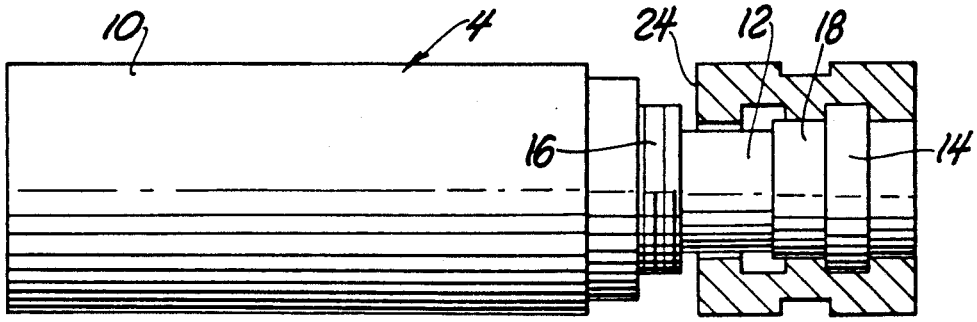
FIG. 2 is an elevational view of a switch mechanism and my collar in a locked out position.

It is of course possible to construct switch assembly 2 so that switch assembly 2 is in the closed, circuit completing mode when plunger 12 is in the extended position shown in FIG. 2. In this case collar 6 locks switch assembly 2 in the closed position when the collar causes plunger 12 to be extended.

Figure 4A:
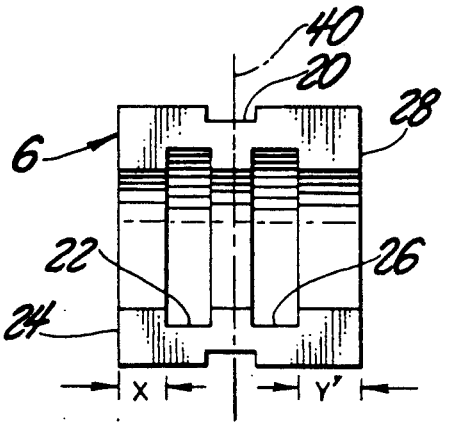
FIG. 4A is an elevational view of one of the two halves of a slightly modified version of my collar.

Another embodiment of collar 6 results if dimension "x" in FIG. 2 is made greater than a dimension "y" so that collar 6 is asymmetrical with respect to plane 40. This other embodiment is illustrated in FIG. 4A, FIG. 4 being the same as FIG. 4 except that dimension "y'" is greater than either dimension "x" or "y". Switch assembly 2 can be constructed so that when plunger 12 is in a fully extended position, there will be a gap of a predetermined minimum size between annulus 16 and end 24. The size of the gap will be specially selected so that when plunger 12 is retracted far enough to abut end 24 with annulus 16, switch assembly 2 will go from an open mode to to a closed mode. The spring loading on plunger 12 will be such that plunger 12 is biased away from abutting engagement with annulus 16 and toward the fully extended position. Thus, a human operator can keep switch assembly in an open condition only so long as manual force is maintained on the switch. As mentioned before, it is possible to construct switch assembly 2 so that the assembly is in the closed condition when plunger 12 is in the fully extended position. The assembly will then be in an open condition when end 24 abuts annulus 16.

Figure 8:
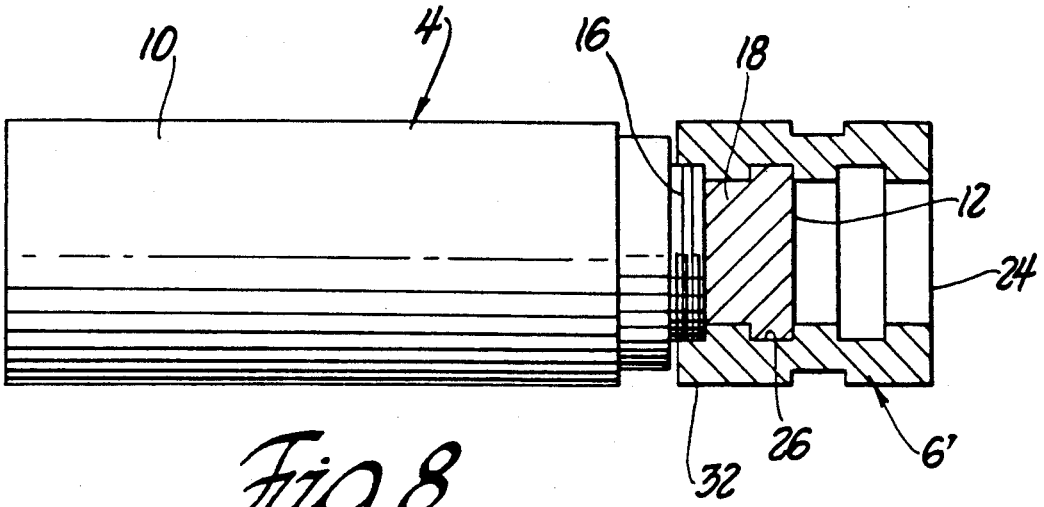
FIG. 8 is a switch mechanism with an alternate embodiment of my collar thereon.

Shown in FIG. 8 is still another modification of my collar, denoted at 6', wherein the collar has an annular extension 32 which is threadingly engageable with the outer cylindrical surface of annulus 16. In this Figure, mechanism 4 is shown in a configuration where plunger 12 is in a retracted position and collar 6' is threaded onto annulus 16 so that mechanism 4 is locked in a closed mode. Collar 6' can be unscrewed from annulus 16 and manually held in abutting contact with this annulus and mechanism 4 will still be in a closed condition. Release of manual retention of collar 6' will permit the bias acting on plunger 12 to translate plunger 12 away from body 10 to the plunger's fully extended position, where mechanism 4 is in the open mode. Similarly to previous discussion, mechanism 4 can be structured so that the extended position of the plunger corresponds to a closed mode of the mechanism and the semi-retracted position of plunger 12 corresponds to an open mode of the mechanism.

Figure 9:
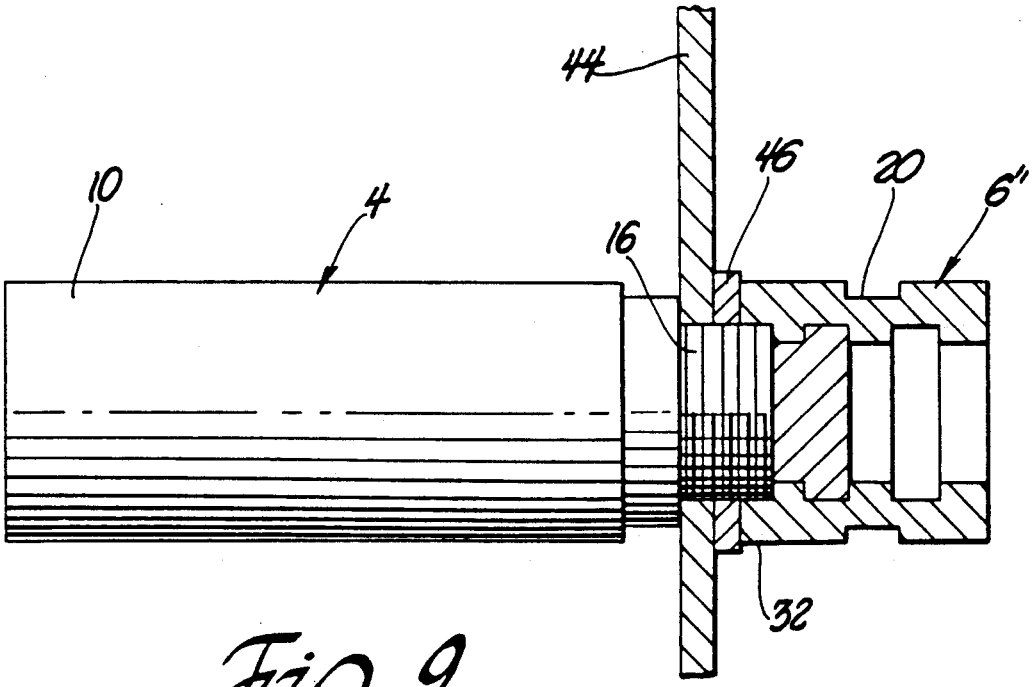
FIG. 9 shows the FIG. 8 embodiment of my collar and a switch mechanism associated therewith, the switch mechanism having means to fix the mechanism to a panel wall.

FIG. 9 shows essentially the same collar 6" and switch mechanism 4 shown in FIG. 8 except that annulus 16 has a greater axial length than in FIG. 8 and switch mechanism 4 is fastened to a panel wall 44 by means of a nut 46. FIG. 9 shows only one of the many possible ways switch mechanism 4 can be fastened to a panel wall so as to expose threads on annulus 16 for engagement by collar 6". Optionally, the hole in wall 44 through which mechanism 4 extends can threadingly engage annulus 16 so as to make nut 46 unnecessary.

I wish it to be understood that I do not desire to be limited to the exact details of construction shown and described herein since obvious modifications will occur to those skilled in the relevant arts without departing from the spirit and scope of the following claims.

I claim:

1. A combined assembly of a switch assembly and a device for immobilizing the switch assembly in a selected position; wherein the switch assembly includes a body, an annulus on the body and a translatable plunger passing through the annulus; the plunger having a round head fixed relative to a shaft, and an intermediate diameter section connecting the head to the shaft; the plunger translatable between a first, retracted position and a second, extended position; the switch assembly having an open condition and a closed condition, the switch assembly being in one of the conditions when the plunger is in the extended position, the switch assembly being in the other of the conditions when the plunger is in the retracted position; the plunger being biased away from positions intermediate the retracted and extended positions;

the device including a sleeve comprised of two mated halves;

the sleeve defining an axial opening at each end;

the sleeve having internal wall surface concentric with the axial openings;

the sleeve further defining a pair of internal annular grooves at the internal wall surfaces, the head closely fittable in either of the pair of groves, one internal groove being less remote from the first axial opening than another of the internal grooves, the other internal groove being less remote from a second axial opening than the one internal groove;

wherein when the head is in the one internal groove and the second opening faces the annulus, a portion of the sleeve between the second axial opening and the one internal groove prevents the plunger from being translated toward its retracted position;

the device further comprising retention means engaging the sleeve for fastening the two halves of the sleeve together.

2. The device of claim 1 wherein the head is in the other internal groove and the second opening faces the annulus, the device further having a knob comprised of:

an interior end fit closely in the one internal groove of the sleeve;

a shank portion connected to the interior end and extending through the first opening of the sleeve;

an exterior end external to the sleeve and connected to the shank portion.

3. The device of claim 1 wherein the internal annular grooves are of the same size and shape.

4. The device of claim 3 wherein the distance between the first opening and the one internal annular groove is equal to the distance between the second opening and the other internal annular groove.

5. The device of claim 1 wherein the plunger has a first, fully extended position and a second, incompletely extended position, the plunger being locked in the first extended position when the head is in the other internal groove and the first opening faces the annulus, the plunger being movable between the first and second extended positions when the head is in the one internal groove and the second opening faces the annulus, the switch assembly being in one of the conditions when the plunger is in the second extended position.

6. The device of claim 1 wherein the sleeve has means at one of the openings to attach the sleeve to the annulus, whereby the plunger is locked in retracted position.

7. The device of claim 6 wherein:

the annulus is externally threaded;

the means to attach the sleeve to the annulus is a threaded annular extension on the sleeve, threads on the sleeve being matable with threads on the annulus; and the extension is rotatable about the plunger.

8. A combined assembly of a switch assembly and a device for immobilizing the switch assembly in a selected position; wherein the switch assembly includes a body, an annulus on the body and a translatable plunger passing through the annulus; the plunger having a round head, a shaft, and an intermediate diameter section connecting the head to the shaft, the intermediate diameter section having a diameter greater than that of the shaft and smaller than that of the head; the plunger translatable between a first, retracted position and a second, extended position; the switch assembly having an open condition and a closed condition, the switch assembly being in one of the conditions when the plunger is in the extended position, the switch assembly being in the other of the conditions when the plunger is in the retracted position; the plunger being biased away from positions intermediate the retracted and extended positions;

the device comprising a radially symmetric sleeve comprised of two identical, mated halves having semicircular cross sections;

the sleeve defining an axial opening at each end, the sleeve having an internal diameter at least as great as the intermediate diameter section of the plunger;

the sleeve having internal wall surfaces concentric with the axial openings;

the sleeve further defining a pair of internal annular grooves at the internal wall surfaces, the head closely fittable in either of the pair of grooves, one internal groove being less remote from a first axial opening than another of the internal grooves, the other internal groove being less remote from a second axial opening than the one internal groove, the axial distance between the one internal groove and the first axial opening being a chosen distance which is greater than a predetermined axial distance between the other axial groove and the second axial opening;

wherein when the head is in the one internal groove and the first opening faces the annulus, the chosen distance between the first axial opening and the one internal groove prevents the plunger from being translated beyond a predetermined point toward its retracted position, and wherein the plunger at the predetermined point is biased toward the extended position and places the switch assembly in the other condition;

wherein when the head is in the other internal groove and the second opening faces the annulus, the axial distance between the second axial opening and the other internal groove permits the plunger to be translated to the retracted position;

wherein when the head is in the other internal groove and the second opening faces the annulus, the axial distance between the second axial opening and the other internal groove permits the plunger to be translated to the retracted position;

wherein when the head is in the other internal groove and the first opening faces the annulus, the plunger is locked in the extended position;

the sleeve further defining an external annular groove;

retention means engaging the external annular groove for fastening the two halve of the sleeve together.

* * * * *

UNITED STATES PATENT AND TRADEMARK OFFICE

CERTIFICATE OF CORRECTION

PATENT NO. : 5,039,829

DATED : August 13, 1991

INVENTOR(S) : Brucksch

It is certified that error appears in the above-identified patent and that said Letters Patent is hereby corrected as shown below:

On the title page: Item [73] should read -- U.S.Government as represented by the Secretary of Army --.

Signed and Sealed this

Eighth Day of June, 1993

*Attest:*

Michael K. Kirk

MICHAEL K. KIRK

*Attesting Officer*

*Acting Commissioner of Patents and Trademarks*